United States Patent [19]

Laurent

[11] 4,166,362

[45] Sep. 4, 1979

[54] METHODS OF AND THERMODYNAMIC APPARATUSES FOR POWER PRODUCTION

[75] Inventor: Robert E. L. Laurent, Marly-le-Roi, France

[73] Assignee: Electricite de France (Service National), Paris, France

[21] Appl. No.: 779,796

[22] Filed: Mar. 21, 1977

Related U.S. Application Data

[63] Continuation of Ser. No. 582,885, Jun. 2, 1975, abandoned.

[30] Foreign Application Priority Data

Jun. 18, 1974 [FR] France ..... 74 21178

[51] Int. Cl.[2] ..... F02C 7/02; F01K 25/00

[52] U.S. Cl. ..... 60/39.18 R; 60/651; 60/671

[58] Field of Search ..... 60/39.02, 39.18 R, 39.18 B, 60/644, 645, 651, 671; 165/134

[56] References Cited

U.S. PATENT DOCUMENTS

| | | | |
|---|---|---|---|
| 2,294,700 | 9/1942 | Stroehlen | 60/39.18 B |
| 3,164,958 | 11/1968 | Pacault | 60/39.18 B |
| 3,218,802 | 11/1965 | Sawle | 60/649 |
| 3,321,009 | 5/1967 | McGee et al. | 165/1 |

*Primary Examiner*—Louis J. Casaregola

*Attorney, Agent, or Firm*—Cushman, Darby & Cushman

[57] ABSTRACT

An improved binary cycle sulphur-water power plant comprising a closed topping sulphur loop and a water loop. The sulphur is vaporized in a heat exchanger where it is at approximately the same pressure as a heating fluid (combustion gas or coolant of a nuclear reactor for instance).

8 Claims, 6 Drawing Figures

12
13
10
11
Na
Na
14
S
16
21
15
17
H2O
19
18
20

14
16
18
19
21
17
22
15
H2O
20
25
23
26
24

METHODS OF AND THERMODYNAMIC APPARATUSES FOR POWER PRODUCTION

This is a continuation, of application Ser. No. 582,885 filed June 2, 1975 (abandoned).

BACKGROUND OF THE DISCLOSURE

The invention relates to thermodynamic power production, and more particularly to binary vapor power plants and power production processes including both a superheated steam cycle and a second or "topping" cycle using another working medium permitting to achieve an inlet temperature higher than steam.

In conventional power plants, the working medium is water. However, the thermodynamic properties of water are such that no real increase in efficiency can be expected by increasing the superheat temperature. The heat sources which are available at present or which will be available in the near future can provide temperatures at which the theoretical efficiency of the cycle is increased very appreciably, but the theoretical increase cannot be exploited if water is used as coolant, inter alia because of the considerable irreversible flows of heat it causes in supercritical cycles.

More particularly, in contrast to light-water and $CO_2$ and graphite reactors, which can produce only moderate temperatures, nuclear reactors now in service or under design (inter alia metal cooled fast neutron reactors, high-temperature gas reactors, liquid-salt reactors) can produce temperatures of up to 850° C. or more. Similar considerations apply to the planned oxygen torch boilers. Later on, fusion will be another means of achieving very high temperatures.

In all such cases the use of a single cycle using steam as the working medium makes it impossible to take advantage of the high temperatures achieved.

The use of binary cycles has already been suggested. More particularly, a topping mercury cycle was added to the low-pressure steam cycle, mercury having the advantage of being liquid at ambient temperature and having a low saturating vapour pressure. On the other hand, it has disadvantages, inter alia its costs and toxicity.

A binary potassium-water cycle was also suggested; unfortunately, potassium has serious disadvantages; it is highly corrosive; it entails an upstream steam cycle associated with considerable irreversible phenomena; and it requires a very low absolute turbine exhaust pressure which is difficult to maintain at the normal turbine exhaust temperature.

Another prior art binary vapor power plant (U.S. Pat. No. 3,218,802 to David R. Sawle) includes a boiling sulphur nuclear reactor. The vaporized sulphur expands in a turbine, flows, through a stream superheating heat exchanger and is condensed in a heat sink; the condensed sulphur is then conveyed back to the reactor. Sulphur used as a working fluid in the topping cycle can be fed to the turbine as saturated vapour, thereby reducing the irreversible flows of heat. Due to the specific thermodynamic properties of sulphur, the vapour is superheated at the exhaust of the turbine, and the irreversible phenomena in the steam superheating heat exchanger are consequently decreased. The temperature and pressure at the exhaust of the sulphur vapour turbine are compatible with present day technology. Last, sulphur is less reactive than potassium and much less costy than mercury. It is not noxious.

On the other hand, sulphur has a detrimental effect on nickel at the temperature in the topping cycle and consequently corrodes those austenitic steels which have a high nickel content and the structural elements in contact with sulphur connot be made with such steels. However, the Cr-Mo alloyed steels have a poor resistance to creep above 550° C. The Cr, Mn or Mo alloyed ferritic steels, even if surface coated, have a long term resistance to creep above 700° C. which is unsufficient and they are not adapted for use in manufacturing exchange tubes subjected to a pressure differential in excess of 20 bars. In short, U.S. Pat. No. 3,218,802 does not provide any indication to the man of the art which would enable the latter to design a plant, particularly using fossil fuel. Last, the neutronic and thermal properties of sulphur are such as to render the development of a boiling sulphur power reactor at least doubtful.

SUMMARY OF THE INVENTION

It is an object of the invention inter alia to improve upon the prior binary cycle thermodynamic power production process and installation. The invention accordingly provides a method wherein a heat source is used to vaporize sulphur, which is expanded in a turbine and which is condensed by heat exchange with water, before returning to the heat source, and the water in its vapour phase is expanded in a turbine having a condenser from which the water returns to the heat exchanger, heat being transferred to sulphur from a primary fluid at a pressure substantially equal to the pressure of vapourized sulphur.

A thermodynamic power production plant according to another aspect of the invention comprises: a heat source; a sulphur first loop and receiving heat from the source to convert the sulphur to saturated vapour; a sulphur expansion turbine receiving said saturated vapour and converting part of the heat of the sulphur into mechanical energy; heat exchanger means to which the sulphur returns in liquid condition; and a second loop flowed through by water and steam and having said exchanger and means located downstream of said exchanger for steam expansion and condensation, and means for returning the water to the heat exchanger means, wherein the heat source comprises substantially equipressure heat exchanger means.

The steam cycle typically includes evaporation and superheating in said heat exchanger means, then resuperheating in the exchanger, and includes steam drains. The sulphur vapour cycle also used reheats and/or drains, to reduce irreversible flows of heat. Because of the very special properties of sulphur, with a heat source temperature which heats the sulphur to from 750° to 800° C., the following consecutive conditions are found: saturated vapour at a pressure of from approximately 25 to 30 bars, which is intaken into the vapour turbine, in which isentropic expansion of the sulphur vapour occurs; and, at the turbine exhaust, superheated sulphur vapour which can be used to superheat and reheat the steam. The desuperheated sulphur vapour can also be used to evaporate the second-cycle steam. A Rankine cycle efficiency of 65% is therefore a possibility, a Figure which, having regard to the organic efficiency of the boiler, should give an overall efficiency of something like 60%.

The nature of the heat exchanger used depends upon the nature of the heat source. In the case of a nuclear reactor, the exchanger is flowed through by the reactor coolant and by sulphur. A feature of interest here is that sulphur, being substantially inert to sodium and water, provides extra safety in liquid sodium cooled reactors by acting as a barrier between sodium and water; in the case of a boiler air must be introduced at the balancing pressure, something which can be achieved very readily since the sulphur vapour pressures are low (20 to 25 bars).

Also, to withstand the air pressure the boiler enclosure can be constructed of prestressed concrete, thus making it possible to omit most of the framework which is required for conventional boilers and to which the exchange tubes are secured and to avoid creepage problems with the framework steels.

The invention will be more clearly understood from the following description of installations which are exemplary non-limitative embodiments of the invention, reference being made to the accompanying drawings wherein.

DESCRIPTION OF PREFERRED EMBODIMENTS

Figure 1:
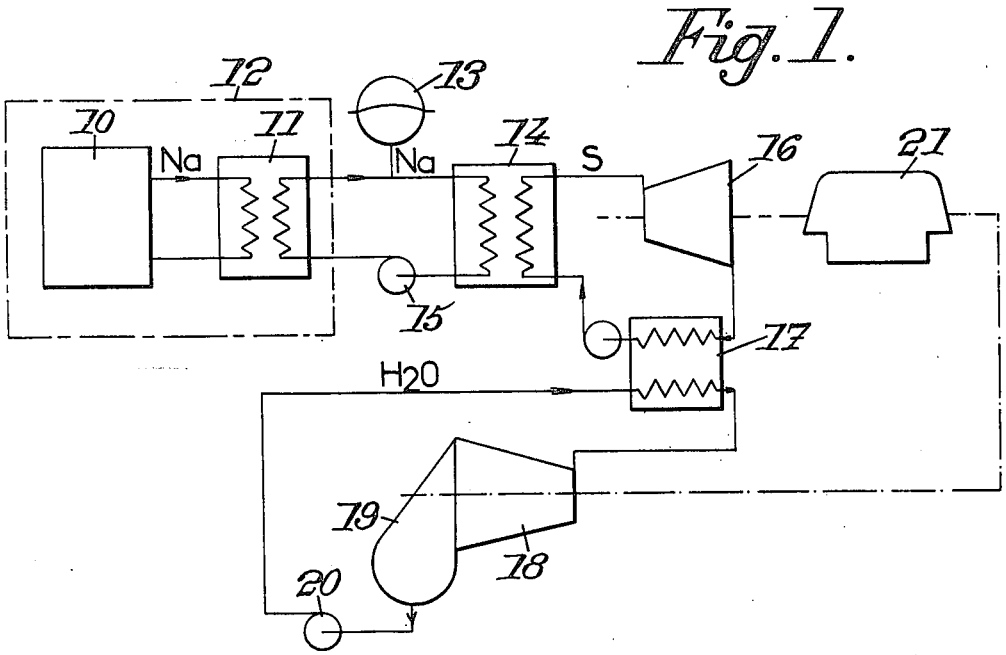
FIG. 1 is a schematic diagram of a binary sulphur/-water cycle power plant in which the heat source is liquid sodium cooled nuclear reactor.

Referring to FIG. 1, there is shown a fast neutron nuclear reactor cooled by a liquid alkali metal, usually sodium, which is at a pressure near atmospheric pressure. Reactor 10 is associated with a heat exchanger 11 for transferring heat between the reactor primary coolant, which may be contaminated by radioactive products in the event of a fuel element can failure, and a secondary coolant which is also liquid sodium. Reactor 10 and exchanger 11 are enclosed in a safety containment 12. The primary-coolant sodium has, for instance, an exit temperature of 850° C. and an absolute pressure of approximately 1 bar. The secondary-coolant sodium has for instance an exit temperature of 820° C. and an absolute pressure of 25 bars maintained by a nitrogen-atmosphere pressurizer 13 which also serves as expansion vessel.

The system embodied by the reactor 10 and the exchanger 11 forms the heat source. The secondary-coolant loop comprises a sodium-sulphur heat exchanger 14 and a pump 15 which returns the sodium leaving the exchanger 14 to the inlet of exchanger 11.

As previously stated, the heat-exchange tubes in contact with sulphur cannot be made of a nickel-containing alloy since the nickel is attacked and there is a continuous production of nickel sulphide. Consequently, the nickel steels normally used to withstand high pressures at temperatures above 550° C. cannot be used for the tubes of the exchanger 14. However, the pressures are considerably less in the case of the diagram shown in FIG. 1 because the intermediate exchanger 11, which has to be provided anyway, serves as a pressure offset device. Exchanger 11, which is in contact only with sodium, can be made of a high-nickel content austenitic steel and can be devised to withstand creep at a pressure of the same order as the pressure in those tubes of the exchanger 14 through which sulphur flows. Consequently, the exchanger 14 is an equi-pressure device and can be made, for instance, of ferritic steels containing chromium, molybdenum and manganese. To further increase sulphur corrosion resistance the steels can be surface treated by chromium cementation or chromium aluminization or some other known process.

Downstream of the exchanger 14 the sulphur loop includes a sulphur vapour turbine 16 which may be multistage. Those parts of the turbine which are in contact with the high-temperature high-pressure sulphur vapour must be made of a material which can withstand corrosion and creep, but high-cost alloys can be used in contrast to the heat exchangers, because the amounts involved are quite different. More particularly, moving fins or ribs made of titanium or tantalum alloy can be used for the high-pressure stage.

The sulphur vapour leaving the turbine goes to a sulphur-water exchanger 17 which the sulphur leaves in liquid form for return to the sulphur-sodium exchanger 14.

The loop is typically designed so that the sulphur vapour is saturated at entry into turbine 16 and superheated at the exhaust, so that in the exchanger 17, which acts as a steam generator, steam is superheated by the superheated sulphur and water is evaporated by condensation of the sulphur. One possibility is to have a temperature of 750° C. and a pressure of 25 bars absolute at the turbine entry and a temperature of 475° C. and a pressure of 0.16 bar absolute at the turbine exit.

The second loop is similar to that of a conventional supercritical steam plant, except as regards the vapour generator and possibly the superheater feed, and has a multi-stage turbine 18 having a condenser 19 from which condensed water is returned to exchanger 17 by feed pumps 20. The turbines drive one or more alternators 21, the number thereof depending on the number of shaft lines. For instance, the temperature and pressure at the turbine entry can be 530° C. and 110 bars respectively (after going through bleed-fed superheaters) and the temperature at the condenser 25° C.

The resulting installation can provide very high Rankine efficiencies of more than 65% for first costs comparable with that of supercritical single-cycle power plants including a reactor with an output temperature of 750° C. or more. Also, the addition of a sulphur loop which separates sodium and water increases safety.

Figure 2:
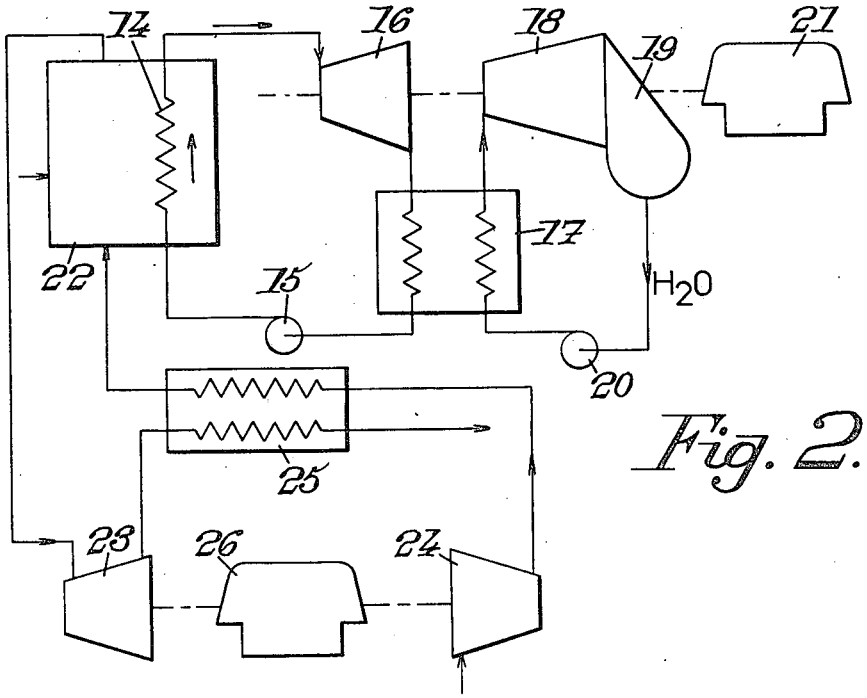
FIG. 2 is a view similar to FIG. 1 of an installation in which the heat source is a fossil fuel boiler.

The installation shown in FIG. 2, where like elements have the same references as in FIG. 1, uses as heat source the combustion gases of a fossil fuel such as coal, which is tending to replace oil products. The water loop is similar to the loop in FIG. 1 and will not be described again. The upstream or "topping" loop comprises a combustion-gas/sulfur exchange tube bundle 14 which serves as sulphur vapour generator and which should not be subjected to a substantial pressure differential. The sulphur vapour flowing along the exchange tubes must, however, be at a slight over pressure, to obviate inflow of air in the event of a tube failure.

Pressurized air is delivered to the boiler 22 at a flow rate which can correspond to a slight excess of air over stoichiometric combustion conditions. The high-temperature combustion gases leaving boiler 22 are circulated through one or more gas turbines before they enter an heat exchanger 25 for heating the combustion air. The or each gas turbine, in which the gas expands and is cooled, e.g., from 750° to 200° C., renders it possible to considerably reduce the size of the air heater 25, from which the gas flows at a temperature of, e.g., 130° C. to the stack.

Air intaken from atmosphere, for instance at 15° C., is compressed by a multi-stage inter-stage-cooled compressor 24 which can be driven by the gas turbine 23. The excess power of the gas turbine is used to drive an alternator 26 coupled with the turbine shaft. The air delivered by the compressor 24 at the pressure of e.g. 24 bars, which is necessary for pressure balance in exchanger 14, is heated by air heater 25 to a temperature which can be approximately 180° C.

The very simplified diagram of FIGS. 1 and 2 show only the main elements of the installation, omitting all the auxiliary elements serving inter alia to reduce the irreversible flows of heat and therefore to increase the overall efficiency of the plant.

Figure 3:
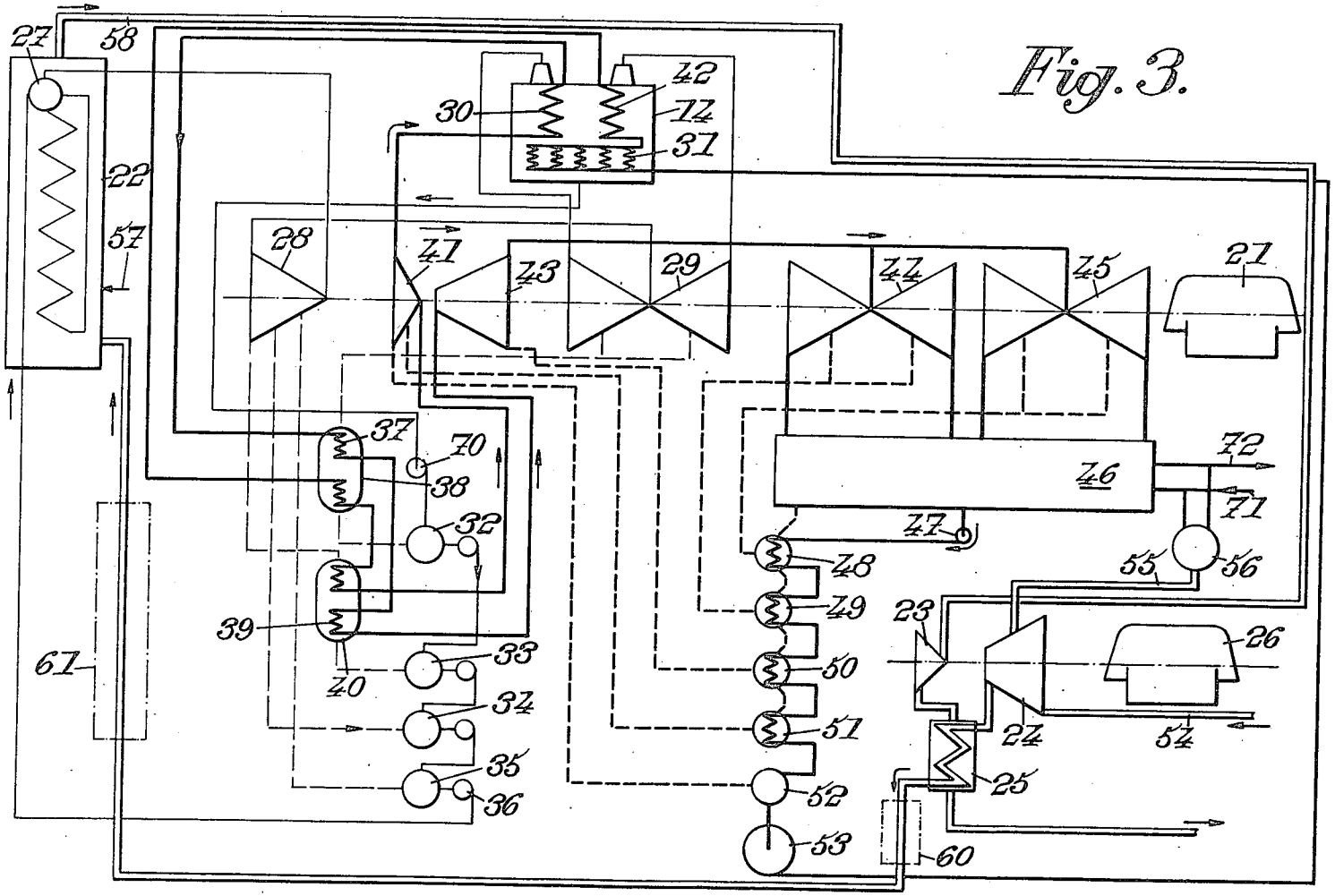
FIG. 3 is a detailed view of an installation corresponding to the diagram of FIG. 2.

FIG. 3 is a more detailed view of a plant corresponding to the simplified diagram of FIG. 2. It should be understood that in FIG. 3 as in FIG. 2 many of the constituent parts shown may in fact include a plurality of associated separate units operating in parallel. For the sake of simplicity, like elements in FIGS. 2 and 3 have the same references and the main circuits of air and combustion gas, of water and of sulphur are shown in double line, dotted line and thin line respectively. Circuits having a small rate of flow, particularly the bleeds, are shown in chain line.

Starting from the vessel 27 of boiler 22, the sulphur circuit comprises a high-temperature high-pressure turbine 28 exhausting without reheating into a medium-temperature double-case turbine 29. The same exhausts to the sulphur/water exchanger 14 which can be of similar construction to a conventional "Benson" or "Sulzer" boiler.

In heat exchanger 14 the superheated sulphur vapour leaving the turbine first sweeps a bundle 30 of water-superheating tubes. The desuperheated sulphur then sweeps a water-evaporating tube bundle 31, then leaves exchanger 14 in a liquid form. Before returning to the boiler, the condensed sulphur is pumped by extraction pumps 70 to cascaded heaters 32–35 fed with sulphur drains in a manner which will be described hereinafter. Forced circulation of the sulphur is provided by feed pumps associated with each heater, the final pump 36 returning the sulphur to the tubing of boiler 22.

In one embodiment of the invention, a sulphur loop can be provided in which the temperatures and pressures are as follows:

24 bars and 750° C. (saturated vapour) at the exit of the exchange tubing of boiler 22;

a temperature of 475° C. and a pressure such that the sulphur is in superheated condition, at the exhaust of the medium-temperature turbine 29;

a temperature of 34° C., corresponding to a saturation pressure of 0.16 bar at the exit of exchanger 14, and a temperature of about 700° C. at the inlet of the exchange tubing of boiler 22.

The superheated steam delivered by the superheating tubing 30 of the exchanger 14 goes to the exchange tubing 37 of a superheater 38 fed with drains from the intermediate pressure sulphur vapour turbine 29. The sulphur vapour which has circulated in superheater 38 reaches the mixing heater 22 at a temperature of, e.g., approximately 570° C. The water steam leaving tubing 37 is superheated again in tubing 39 of a second superheater 40 which receives drains from the high temperature sulphur vapour turbine 28. The sulphur vapour leaving superheater 40 at a temperature of, e.g., 620° C. goes to the second preheater 33. In this case, the last two preheaters 34, 35 are, for instance, directly supplied by drains from the high-temperature sulphur vapour turbine 28 at temperatures of 670° C. and 720° C. respectively.

The superheated steam leaving tubing 39 at a temperature of, e.g., 530° C. and a pressure of 110 bars reaches high-pressure steam turbine 41 which exhausts to the reheating tubing 42 of exchanger 14. Tubing 42 can be similar to tubing 30. The resuperheated steam passes through tubings (similar to the tubings 37 and 39) in the superheaters 38, 40 before entering a medium-pressure steam turbine 43, whence it is distributed between the low-pressure double-casing steam turbines 44 and 45. The same are associated with a conventional steam condenser 46 which can be cooled by raw water which enters at 71 and leaves at 72. The condenser can be so devised, for instance, that the feed pump 47 returns water at 25° C. at a saturation pressure of 0.035 bar.

To reduce irreversible flow of heat, the water leaving the condenser is heated, before it is returned to the evaporating tubing 31 of the exchanger 14, in cascaded heaters 48–52 fed by extractions arranged on the steam turbines. In the exemplary diagram shown:

the heater 48 is fed from an extraction on the turbine 45 at a temperature of, e.g., 58° C.;

heater 49 is fed from an extraction on turbine 44 at a temperature of, e.g., 180° C.;

heater 50 is fed from an extraction on the medium-pressure turbine 43 at a temperature of, e.g., 350° C.; and heaters 51 and 52 are fed from extractions on the high-pressure steam turbine 41 at temperatures of, e.g., 300° and 420° C. respectively.

The feed pumps 53 return the water at a temperature of, e.g., 262° C. to the evaporating tubes 31 of exchanger 14.

Since, as previously stated, austenitic steels, the only economic materials able to withstand high-temperature creep, cannot be used for the sulphur-contacting tubes, the exchange tubes must operate in balanced-pressure conditions. A pressurized-combustion-chamber boiler is therefore used and is operated so that at the output of boiler 22 combustion gases are available at a temperature and pressure of the same order as for the sulphur vapour produced. In the embodiment shown in FIG. 3, a compressor or blower 24 compresses atmospheric air intaken at 54 to an appropriate pressure. Compressor 24 is normally of the multi-stage kind with interstage cooling. For the sake of simplicity, the compressor 24 of FIG. 3 is shown as being connected to a single pipe 55 to an exchanger 56 cooled by raw water. The compressed air leaving the compressor 24 is heated by the exhaust gases in a heat exchanger 25 which will be described further hereinafter. Air at a temperature of, e.g., 180° C. and a pressure of 24 bars is therefore delivered to the furnace of the boiler 22. Combustion of the fossil fuel introduced at 57 evolves combustion gases which first heat the gas-sulphur exchange tubing, then leave through ducts 58 at high temperature and pressure, e.g., 750° C. and 23 bars. The gases are then expanded in a plurality of multistage gas turbines 23 arranged for parallel flow. Only one turbine is shown and it drives compressor 24 and alternator 26 (which can be the same as alternator 21). The gases then pass through exchanger 25 to atmosphere.

In view of the required sulphur pressures and hence of the intake air pressures, it is virtually necessary to provide the compressor 24 with interstage cooling exchangers since the temperature of the air therein may vary over a wide range, e.g., between 25° and 100° C. On the other hand, the gas turbines 23 do not include the most expansive item of conventional gas turbine plants, viz, the combustion chamber, since the boiler 22 acts in lieu thereof. Also, using the boiler 22 as combustion chamber for the gas turbine 23 helps to reduce considerably the excess of air usually required to keep the turbine inlet temperatures at industrially acceptable temperatures.

Figure 6:
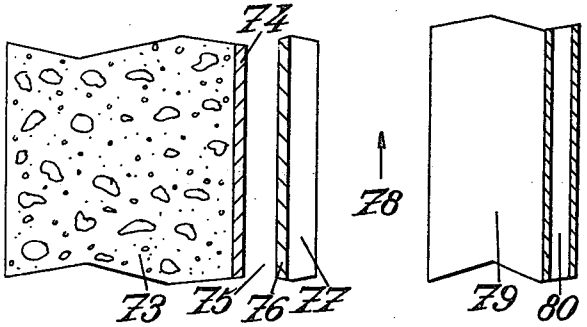
FIG. 6 is a very diagrammatic view of a possible construction for the boiler wall of the installation shown in FIG. 3.

Since the sulphur vapour boiler 22 is supplied with pressurized air, it can be considerably smaller than a conventional water boiler. This reduction in size is particularly advantageous in the light of the present trend towards increased unit capacities. In practice, the boiler 22 can have a prestressed concrete vessel even for a 1200 MW Plant—i.e., using a now well-developed and relatively low-cost technology—which in this particular case makes it possible to omit most of the tube suspension structure required in conventional boilers and making up a considerable proportion of their costs. FIG. 6 shows one possible construction for the wall of such a boiler; a prestressed concrete pressure vessel 73 is maintained at a temperature compatible with the maintenance of its mechanical strength by a flow of air in a gap 75 between an internal metal skin 74 of the vessel and a sealing sheet-metal member 76 lined with a heat-insulating layer 77. The heat insulant 77 can be of a kind unable to withstand high temperatures if it is separated by an annular space 78, which is wide enough for access for inspection, from a thick insulating layer 79 which can withstand high temperatures and which can be of the kind at present used in nuclear reactors. The inside surface of layer 79 carries heat exchange tubes 80 located adjacent to each other and flowed through by sulphur.

Also, associating the gas turbine 23 with the air compressor 24 makes it possible, by using the expansion energy of the combustion gases in the turbine 23, to reduce very considerably the weight of the air/combustion gas exchanger 25 as compared with conventional boilers. The bulk of such exchanger would become prohibitive in the case of a boiler not supplied with compressed air.

The plant shown in FIG. 3 may be complemented with extra heaters for the boiler air feed; advantageously, such heaters use the existing sulphur vapour drains on the turbines. The usefulness of this solution is not so much an improvement in overall efficiency as the possibility of giving the plant a capacity of temporary overload of up to approximately 17% above its rated load, by the addition of an extra gas turbine which does not operate in normal conditions and is used for emergencies and on peak loads to absorb the extra energy of the combustion gases. As a rule, no additional first cost is entailed by adding the extra turbine, since gas turbines are one of the elements of the plant which are likely to suffer breakdowns and the number of turbines provided is always greater than the number actually required, e.g., five turbines instead of four. In the plant shown in FIG. 3, the extra heaters can be provided, e.g., at the positions indicated by frames 60 and 61.

Figure 4:
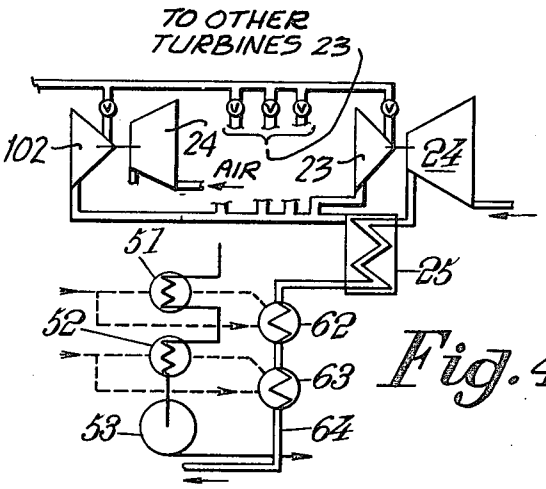

The exchangers 62 and 63 which are shown in FIG. 4 and which form system 60 are disposed at the exit of exchanger 25 and are fed by derivations from the steam drains to the feed water heaters 51 and 52 respectively.

Figure 5:
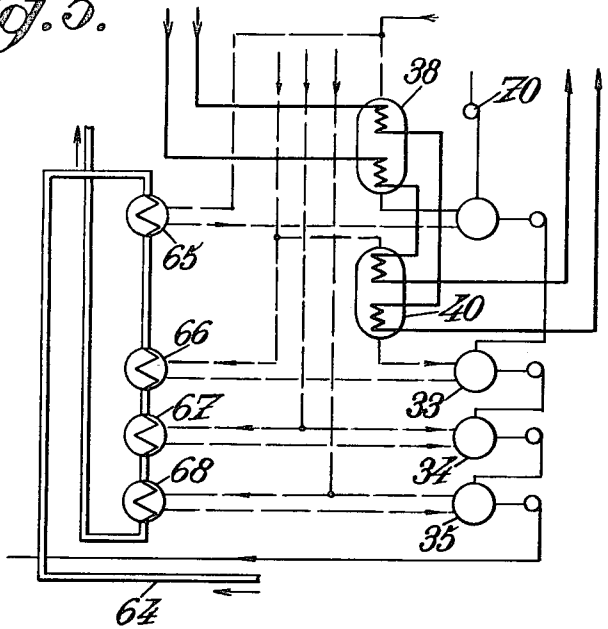
FIGS. 4 and 5 are details showing two portions of the installation of FIG. 3 with additional air heaters.

The air which leaves heater 63 at 64 is directed to a bank of extra air heaters 65–68 which are fed from the drains for the superheater 38, the superheater 40 and the mixing superheaters 34–45 (FIG. 5).

In view of the chemical affinity of sulphur for oxygen, which entails a fire risk in the case of contact between air and sulphur if the temperature is above 250° C., it is highly desirable to interpose between the sulphur flow and the air flow a barrier fluid flow, e.g., of steam, which is inert to sulphur. One possibility is to use double-wall exchanger tubes in which the gap between the walls is flowed through by steam at a lower pressure than the sulphur and the air; in the event of leakage the steam carries the sulphur or air along with it and the presence of the sulphur or air can be detected immediately. The wall in contact with air can be adapted to withstand compressive stresses arising from the pressure differences; this can readily be achieved since high-creep-strength austenitic steels can be used. The wall in contact with sulphur can be made of ferritic steel coated with a protective layer and thin enough to be deformable, so that the pressure difference between the sulphur and the steam applies it to the other wall and enables it to follow differences in expansion due to the different coefficients of expanion of these materials.

When the modified plant shown in FIGS. 4 and 5 is in normal operation, the heaters 62, 63 and 65–68 are in use. It will be assumed, as an example, that four gas turbines are required to take the energy of the combustion gases. To deal with brief peaks of up to 17% of the rated load, the air heater feeds are cut off, giving a corresponding reduction in the steam and sulphur vapour bleed flows. Simultaneously, the rate of fuel flow of the boiler is increased, for instance by the use of extra fuel injectors, and the rate of air flow of the boiler is increased by use of the compressor associated with the gas turbine 102 which is normally kept for emergency operation. The extra combustion gas delivery makes it possible to use the emergency gas turbine, the same outputting to alternator 26. This overload gives rise to no increased heat exchange in boiler 22 between the combustion gases and the sulphur, the rate of flow of which at the inlet of turbine 28 remains constant.

As a consequence, an economical method is provided for devising a plant which can provide a considerable overload but at very low first cost, the extra gas turbine having to be provided anyway as a safety device. The cost of the extra fuel injectors, if they are necessary, is a negligible proportion of the cost of the plant. The air/steam heaters 62, 63 and the air/sulphur heaters 65–68 have only small exchange areas, with a high coefficient of exchange since the air pressure is very much higher than atmospheric pressure. Yet another advantage of the plant is that the sulphur circuit can be heated up readily and rapidly from ambient temperatures.

The plant also includes ancillary equipment (not shown) which is known to the average designer more particularly for cold starting. All elements in which the sulphur may freeze must have electrically heated lines or cords in accordance with a technology which is now conventional, since it is used in liquid alkali metal cooled nuclear reactors. Continuous sulphur and water purification facilities are also necessary to remove impurities picked up by them in their flow and because of the risk of leakages.

I claim:

1. A binary cycle thermodynamic power plant comprising: a heat source; a closed first loop for circulation of sulphur, having a primary heat exchange means for effecting heat exchange between the source and the sulphur to receive the sulphur in substantially liquid condition and to convert the sulphur to saturated vapour, said primary heat exchange means having sulphur containing tubes of ferritic steel which are unreactive with sulphur and have a relatively low resistance to creep; at least one sulphur expansion turbine; and a first heat exchange means to condense the sulphur discharged by said at least one sulphur turbine; a second loop for circulation of water and steam including said first heat exchange means in which the water is evaporated and superheated; heat engine means for expanding and condensing the steam and means for returning the condensed water to said first heat exchange means, wherein said source includes a primary heat transfer fluid, and circulation means for circulating said sulphur and primary fluid at approximately equal pressures in said primary exchange means.

2. A power plant as in claim 1 wherein said heat source is a fossil fuel boiler having heat exchange tubing through which the sulphur can flow, means for supplying the boiler with combustion supporting air at a pressure such that the exit pressure of the combustion gases is at least approximately equal to the pressure of the discharged sulphur vapour.

3. A power plant as in claim 2 wherein said means for supplying air includes an atmospheric-air compressor followed by an air heater, said power plant further including gas turbine means for receiving combustion gases emitted from said boiler and for driving said air compressor, said combustion gases leaving the boiler being expanded in said gas turbine means, and the gas exhaust from the turbine being directed to the air heater as heating fluid thereof and additional heating means for heating the air directed to the boiler, located downstream of the heater supplied by the combustion gases on the air path and heated by the discharges from said heat engine means.

4. A binary cycle thermodynamic power plant, comprising:

a fossil fuel boiler having heat exchange tubing means;

means for supplying combustion supporting air to said boiler, having an atmospheric air compressor and air heater means;

gas turbine means for receiving combustion gases emitted from said boiler and for driving said air compressor, said combustion gases leaving the boiler being expanded in said gas turbine means and the gas exhaust from the turbine being directed to the air heater means as heating fluid thereof;

a closed loop for circulation of sulphur, comprising said heat exchange tubing means for heat exchange between the combustion gas and the sulphur to receive the sulphur in substantially liquid condition and to convert the sulphur to saturated vapour, said heat exchange tubing means having surfaces in contact with sulphur which are unreactive with sulphur and have a relatively low resistance to creep; at least one sulphur expansion turbine; and a first heat exchange means to condense the sulphur discharged by said at least one sulphur turbine;

a second loop for circulation of water and steam, comprising said first heat exchange means in which the water is evaporated and superheated, means for superheating and resuperheating steam, supplied by sulphur vapour drains on said at least one sulphur turbine, heat engine means for expanding and condensing the steam, and means for returning the condensed water to said first heat exchange means, wherein said compressor means are constructed for supplying the combustion supporting air at a pressure such that the exit pressure of the combustion gases is at least approximately equal to the pressure of the discharged sulphur vapour.

5. A binary cycle thermodynamic power plant comprising: a fossil fuel boiler having a primary heat exchange means, means for supplying combustion supporting air under pressure to said boiler;

a closed first loop for circulation of sulphur, including said primary heat exchange means for effecting heat exchange between the fuel combustion gas and the sulphur to receive the sulphur in substantially liquid condition and to convert the sulphur to saturated vapour, said primary heat exchange means having surfaces in contact with sulphur which are unreactive with sulphur and have a relatively low resistance to creep; at least one sulphur expansion turbine; a first heat exchange means to condense the sulphur discharged by said at least one sulphur turbine and circulation means for circulating said sulphur along said loop;

a second loop for circulation of water and steam including said first heat exchange means in which the water is evaporated and superheated, steam turbine means for expanding and condensing the steam and means for returning the condensed water to said first heat exchange means;

wherein said means for supplying air comprises atmospheric air compressor means followed by an air heater, a plurality of gas turbines for receiving combustion gases emitted from said boiler during normal operation and driving said atmospheric air compressor means, said combustion gases leaving the boiler being expanded in said gas turbines, and the gas exhaust from the gas turbines being directed to the air heater as heating fluid thereof, additional heating means for heating the air directed to the boiler, located downstream of the air heater supplied by the combustion gases on the air path and heated by the discharges from said steam turbine means, and an emergency gas turbine drivingly connected to an air compressor located in parallel flow relation with said plurality of turbines, in addition to said plurality of gas turbines, and means for directing combustion gases to said emergency gas turbine for absorbing the extra energy of said combustion gases when peak load conditions exist and simultaneously rendering said additional heating means inoperative.

6. A plant according to claim 4, having means for heating the water coming from the condenser, said means being supplied by drains on the steam turbines.

7. A plant according to claim 4, wherein the additional air heating means are supplied by derivations from the drains to the water heaters and water superheaters.

8. A plant according to claim 4, having an additional heating means for heating the air directed to the boiler, located downstream of the heater supplied by the combustion gases on the air path and heated by the discharges from said heat engine means.

* * * * *